United States Patent [19]

Kawashima et al.

[11] Patent Number: 4,974,373

[45] Date of Patent: Dec. 4, 1990

[54] ABRASIVE TOOLS

[75] Inventors: Norimichi Kawashima; Toshiro Hattori, both of Tokyo, Japan

[73] Assignee: Tokyo Magnetic Printing Co., Ltd., Tokyo, Japan

[21] Appl. No.: 316,903

[22] Filed: Feb. 28, 1989

[30] Foreign Application Priority Data

Mar. 14, 1988 [JP] Japan ..... 63-58392
Apr. 28, 1988 [JP] Japan ..... 63-104038

[51] Int. Cl.[5] ..... B24D 11/00
[52] U.S. Cl. ..... 51/295; 51/293; 51/298
[58] Field of Search ..... 51/293, 295, 298

[56] References Cited

U.S. PATENT DOCUMENTS 3,992,178 11/1976 Markos et al. ..... 51/298
4,011,063 3/1977 Johnston ..... 51/298
4,047,903 9/1977 Hesse et al. ..... 51/298

*Primary Examiner*—William R. Dixon, Jr.
*Assistant Examiner*—Willie J. Thompson
*Attorney, Agent, or Firm*—Seidel, Gonda, Lavorgna & Monaco

[57] ABSTRACT

An abrasive tool comprises a base and an abrasive powder bonded to the base in the form of a single-layer structure in which the particles do not substantially overlap or rest one upon another. For the bonding purpose the abrasive powder is either dispersed in a dilute solution of a binder resin and a solvent for subsequent application of the solution to the base or is spread over and fixed to a binder resin coat formed beforehand on the base.

11 Claims, 5 Drawing Sheets

ABRASIVE TOOLS

BACKGROUND OF THE INVENTION

This invention relates to abrasive tools suited for use in lapping, polishing, texturing, and various other finishes of precision machine parts, e.g., hard disks, magnetic heads, ceramics, plastics, and jewels. The tools of the invention prove particularly effective in texturing and lapping hard disks and flexible disks.

Abrasive tools of the prior art typically comprise a base of polyethylene terephthalate (PET) film, disk, sheet, or the like and a coating material consisting of an abrasive powder dispersed in a binder resin and applied to the base to form a continuous or discontinuous abrasive layer thereon. The abrasive employed is the powder of diamond, alumina, silicon carbide, iron oxide, chromium oxide, or the like.

High precision grinding requires an abrasive powder of uniform particle size distribution. However, the smaller the particle diameter of the abrasive, the greater the difficulties involved in uniformly dispersing the abrasive in the resin because of an increasing tendency toward particle agglomeration. The abrasive particles, when applied in the agglomerated state, can scratch the workpiece or produce an ununiformly ground surface on the workpiece, resulting in uneven grinding. Especially, the surface texturing of magnetic hard disks calls for grinding to uniform width and depth. Conventionally manufactured abrasive tapes for hard disks have an abrasive coat of multilayer structure, with the particles densely in contact with one another and constituting a uniform surface structure, or Bénard cell structure. Microscopically, however, the surface in no way uniform; at multitudinous points agglomerated abrasive particles form larger grains which protrude from the abrasive coat surface to produce deep flaws or scratches on the workpiece.

The uniformity of abrasive surface of an abrasive film is of key importance for a grinding system where the surface structure configurations of the abrasive tape are directly transferred onto the workpiece as the ground surface, as is the case with the texturing of a hard disk. Unfortunately, with conventional abrasive films of multilayer, Bénard cell structure, surface uniformity is seldom attained.

In the grinding of such other workpieces as magnetic heads, agglomerated grains of abrasive again scratch or otherwise damage them. Moreover, dense formation of the grains on the abrasive layer surface provides an enlarged area of contact between the abrasive layer and the workpiece, with a corresponding increase in the friction with the workpiece. This is turn causes fusing of the binder resin and hampers the removal of grinding dust, both leading to loading and shortened abrasive film life.

SUMMARY OF THE INVENTION

It is an object of the present invention to provide an abrasive tool suited for precision grinding with little possibility of damaging the workpiece.

Another object of the invention is to provide an abrasive film with which the working (in terms of the width and depth of grinding) of the workpiece is easy to control and the friction with the workpiece is low enough to suppress loading of the abrasive film with grinding dust.

The invention uses an abrasive tool which comprises a base (backing) such as a polyester film and abrasive particles uniformly dispersed in a substantially single particle layer and bonded to the base. The tool renders it possible to produce a ground surface having a roughness corresponding, in effect, solely to the average particle diameter and particle size distribution of the abrasive employed. Thus, the surface ground with the abrasive tool of the invention has a uniform grinding streak free of irregular scratch or flaw.

In the abrasive tool of the invention, low surface density of abrasive particles limits the area of contact between the abrasive layer and the work surface being ground. Consequently, the tool produces a surface ground more uniformly to a greater depth than yielded by a tool of multilayer structure with a higher abrasive particle concentration. In addition, reduced friction with the workpiece improves the cutting quality and hence the surface finish.

Interstices among the particles serve as chip pockets to prevent loading of the tool and enhances its durability.

In one embodiment of the invention the abrasive particles are dispersed in a thin matrix of binder (a binder resin plus a solvent) and then applied to a base.

The abrasive tool characterized by the abrasive layer so made permits efficient production of a ground surface having a roughness corresponding, in effect, solely to the average particle diameter and particle size distribution of the abrasive used. The surface ground with the abrasive tool of the invention has a consistent ground streak free of damage or other irregularities.

In the abrasive tool of the invention, the individual abrasive particles that constitute cutting edges are not coated with resin. This reduces the tool friction with the work surface and thereby makes high-efficiency precision grinding possible. The invention further provides an abrasive film in which fusion with binder resin and loading with grinding dust are minimized.

DETAILED DESCRIPTION OF THE INVENTION

Figure 1:
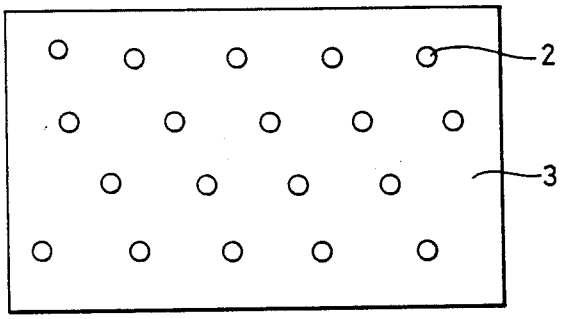
FIG. 1 is a diagrammatic plan view of an abrasive tool according to the invention.
Figure 2:
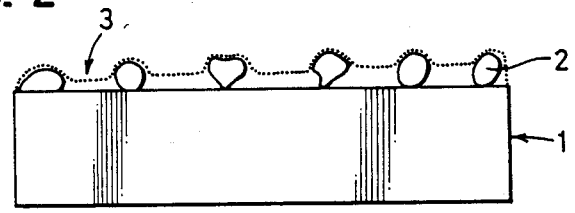
FIG. 2 is a cross sectional view of the tool.

In one aspect of the invention the abrasive tool is characterized by a structure in which abrasive particles are dispersed as uniformly as possible in a single layer and bonded to the base. The basic technical concept will now be explained in conjunction with the accompanying drawings, referring specifically to FIGS. 1 and 2 which are a front view and a cross sectional view, respectively, of a part of abrasive tool according to the invention.

The abrasive tool shown has a structure comprising a base 1 of plastic film, and an abrasive coat or layer consisting of abrasive particles 2 dispersed in a binder resin 3, applied substantially as a single layer to the base.

The term "single particle layer" as used herein means a layer in which there is practically no particle overlapping another. That is, the number of overlaps where two or more particles overlap or where one or more particles rest on another or other particles is preferably limited to one or less per 100 particles, more preferably to one or less per 1,000 particles, and most preferably to one or less per 10,000 particles. This limitation materially reduces the probability that the abrasive tool produces scratches or flaws dissimilar to (i.e., deeper and/or broader flaws than) the surface roughness of the ground surface of a workpiece that is dictated by the average particle diameter of the abrasive particles. Hence high-precision grinding is accomplished. Abrasive particles in contact with one another are acceptable provided that the contact occurs in the horizontal plane. What should be avoided for the purposes of the invention is that abrasive particles overlap vertically, or rest one upon another, to form irregular protuberances.

It has been found that such an abrasive layer of singlelayer structure can be formed relatively easily without relying upon any special method but by selecting a suitable polymeric binder, solvent, and dispersant, proper mixing ratio, coating equipment, amount to be applied, and so forth.

Preferably, in another aspect of the invention, the abrasive tool is characterized by a structure in which abrasive particles are arranged as uniformly and as close to one another as possible or in contact in a single layer bonded to a base (e.g., of polyester film) coated beforehand with an adhesive, with no resin present on the planes of the particles as cutting edges.

Figure 5:
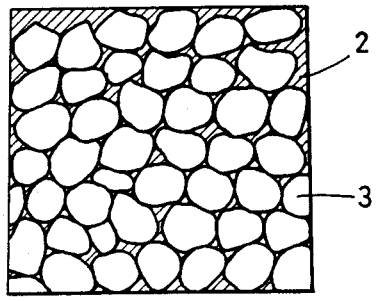
FIG. 5 is a schematic plan view of an abrasive tool according to the invention.
Figure 6:
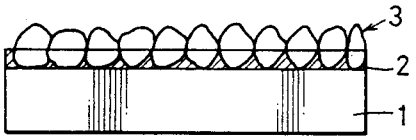
FIG. 6 is a cross sectional view of the tool.

The basic technical concept of this aspect of the invention will become clear from the following description taken in connection with the accompanying drawings, specifically FIGS. 5 and 6 which are a plan view and a cross sectional view, respectively, of a part of the abrasive tool according to the invention.

This abrasive is of a structure having an abrasive layer as a substantially single particle layer which is made by applying an adhesive coat 2 to a base 1 of plastic film.

By a "single particle layer" is meant a layer in which there is practically no overlap of particles; the particles should not rest one upon another, although it is not in the least objectionable that they are merely in contact. Whether a single particle layer has been formed or not can be easily ascertained by observation under an electron microscope, by means of a surface roughness meter, or by electron-microscopic observation of a fragment like the one illustrated in FIG. 6. The absence of a resin layer on the working faces of the abrasive particles as shown that serves as cutting edges, largely reduces the probability that the abrasive tool produces scratches or flaws (in the depth direction and/or the width direction) dissimilar to the surface roughness of the ground surface of a workpiece that is dictated by the average particle diameter of the abrasive particles. This leads to high-precision grinding.

Figure 7:
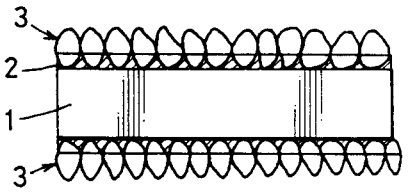
FIG. 7 is a cross sectional view of another form of abrasive tool according to the invention.

In FIG. 7 is shown another structure of the abrasive tool according to the invention. The structure has an abrasive layer substantially as a single particle layer.

The base may be used in the form of a tape or sheet.

Useful abrasives includes diamonds, CBN, silicone carbide, monocrystalline alumina, fused alumina powder, chromium oxide, iron oxide, and cerium oxide.

Abrasives larger than one micron in particle diameter are desirable.

The binder resin to be used is either a thermosetting or thermoplastic resin. Examples of usable thermosetting resins are polyester or acrylic polyol urethane resins, chlorinated polypropylene-modified acrylic polyol urethane resins, acrylic chelate-cured resins, epoxy or epoxy-pendant acrylic resin+aminependant acrylic resins, polyorganosiloxane resins, various ultraviolet-curing resins, urethane oil resins, moisture-curing polyurethane resins, fluororesins, and other similar resins which undergo curing reaction at or below 100° C.

Usable thermoplastic resins include pure acrylic resins, vinyl chloride resins, nitrocellulose resins, nitrocelluloseacrylic resins, modified acrylic resins, alkyds, polyolefin resins, polyester resins, rubber resins such as urethane elastomers, nitrile rubbers, silicone rubbers, ethylene-vinyl acetate rubbers, and fluororubber resins. Other water-soluble resins and emulsion resins also may be employed.

Examples of bases are plastic films of polyethylene terephthalates, polyimides, and polycarbonates with or without surface treatment, sheets of polypropylene, expanded butyl rubber, low-expansion-rate urethane, expanded polyurethane, expanded neoprene, expanded soft polyethylene, expanded synthetic rubber, or the like. Synthetic paper, nonwoven fabric, metal foil or the like may be used as well. Glass and metals also may be utilized as rigid backing materials.

If necessary, lubricant or other additive may be used together with the abrasive particles. It is also possible to coat the abrasive tool with a thin film (e.g., a hard carbon film) formed by plasma synthesis or other technique so as to protect the tool surface.

In one embodiment of the abrasive tool of the invention (FIGS. 1 and 2), the abrasive is mixed with a binder resin and a solvent, and the mixture is applied to a base of film or the like by a proper coating equipment to form a coat of appropriate thickness that depends on the particle size distribution of the abrasive particles.

Examples of coating equipment that may be employed are Meyer coater, gravure coater, reverse roll coater, and knife coater.

The coated film thus obtained is fixedly secured to the base upon drying or curing.

The invention is illustrated by the following examples.

EXAMPLE 1

This example uses a thermoplastic resin as a binder resin for the abrasive layer in an experiment on the manufacture of an abrasive film in accordance with the invention. First, coating solutions were prepared from compositions to be given in a table below.

As the abrasive particles, fused alumina powders of the trade name "WA" were used. Particles of varied meshes with different average particle diameters were mixed each with a binder resin to provide combinations in a powder/resin ratio of 1:1. With WA2000, three different combinations were made with varied powder/resin concentrations to study the influences of different abrasive particle concentrations.

TABLE 1

| | Alumina-thermoplastic type compositions | | | | | | |
|---|---|---|---|---|---|---|---|
| | WA 800 | WA 1000 | WA 1500 | | WA 2000 | | WA 3000 |
| Abrasive particles | 100 | 100 | 100 | 100 | 100 | 100 | 100 |
| Binder resin* ("V 200") | 100 | 100 | 100 | 200 | 100 | 50 | 100 |
| Solvent (cyclohexanone) | 450 | 150 | 300 | 200 | 250 | 150 | 300 |
| Total | 650 | 350 | 500 | 500 | 450 | 300 | 500 |

*Polyester.

Coating solutions of the compositions shown in Table 1 (in which the numerical values are in parts by weight, and "V200" is the trade designation of a polyester resin made by Toyobo Co.) were applied by reverse roll coaters to a 25 μm-thick polyethylene terephthalate film to form coats of varying thicknesses depending on the different particle sizes. After the evaporation of the solvent, the film with different coats was slit into tapes of a predetermined width for use in grinding nickel-plated substrates for hard disks. The average particle diameters of the abrasive powders used were as follows: WA800=20 μm; WA1000=11 μm; WA1500=8 μm; WA2000=7 μm; and WA3000=5 μm.

Conventional high-particle-density abrasive films (hereinafter referred to as films of the multilayer structure type), each made by coating a base with a binder containing a high concentration of the same abrasive particles as used for the abrasive tapes described above but otherwise in the usual manner, were employed for the texturing of hard disks.

Under such conditions that the ordinary abrasive films of the multilayer structure type gave the results of Table 2, grinding was carried out using the abrasive tapes of the invention. The surface roughness and finish conditions attained were as shown in Table 3. By "No. of irregularity" is meant the number of hollows or grooves of significant sizes formed, and "scratch" means the number of streaks thicker and longer than normal grinding streaks.

TABLE 2

| | Surface roughness (Å) | | Microscopic observation | |
|---|---|---|---|---|
| Mesh No. | Ra | Rmax | No. of irregularity | Scratch |
| WA 2000 | 80 | 600 | 5 | Yes |
| WA 3000 | 50 | 400 | 4 | Yes |

TABLE 3

| | Surfaces ground with alumina-thermoplastic type single-layer coats | | | | |
|---|---|---|---|---|---|
| | | Surface roughness (Å) | | Microscopic observation | |
| Mesh No. | | Ra | Rmax | No. of irregularity | Scratch |
| WA 800 | | 500 | 4000 | 0 | No |
| WA 1000 | | 300 | 2000 | 0 | No |
| WA 1500 | | 200 | 1500 | 0 | No |
| WA 2000 | A | 180 | 1350 | 0 | No |
| | B | 160 | 1300 | 0 | No |
| | C | 150 | 1250 | 0 | No |
| WA 3000 | | 80 | 500 | 0 | No |

TABLE 4

| | Ra, Rz, and Rmax values of alumina-thermoplastic type single-layer coats | | | |
|---|---|---|---|---|
| No. | | Ra (μm) | Rz (μm) | Rmax (μm) |
| 800 | | 1.9 | 12.7 | 17.7 |
| 1000 | | 2.1 | 14.1 | 16.0 |
| 1500 | | 1.4 | 8.4 | 9.5 |
| 2000 | A | 0.8 | 5.3 | 6.5 |
| | B | 1.3 | 8.3 | 9.4 |
| | C | 1.4 | 9.0 | 10.3 |
| 3000 | | 0.3 | 2.5 | 3.0 |

As can be seen from Table 3, the abrasive tools having the abrasive coat of single-layer structure in conformity with the invention produced no surface flaw other than the normal grinding streak.

Figure 3:
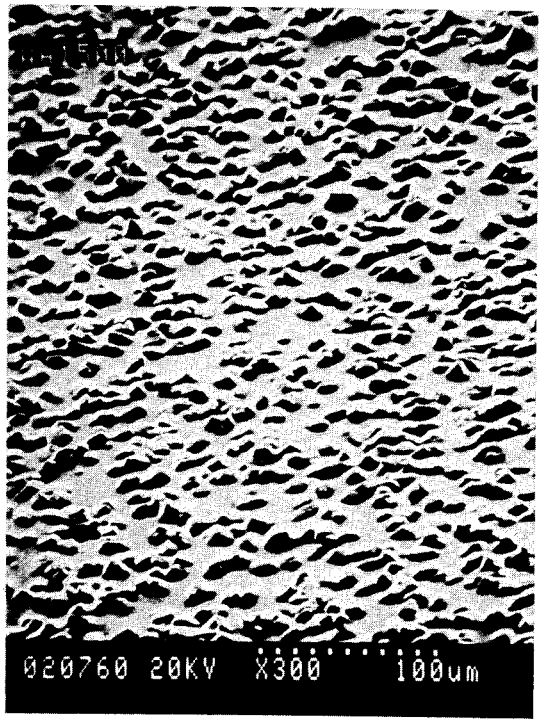
FIG. 3 is a micrograph of an abrasive tool embodying the invention.
Figure 4:
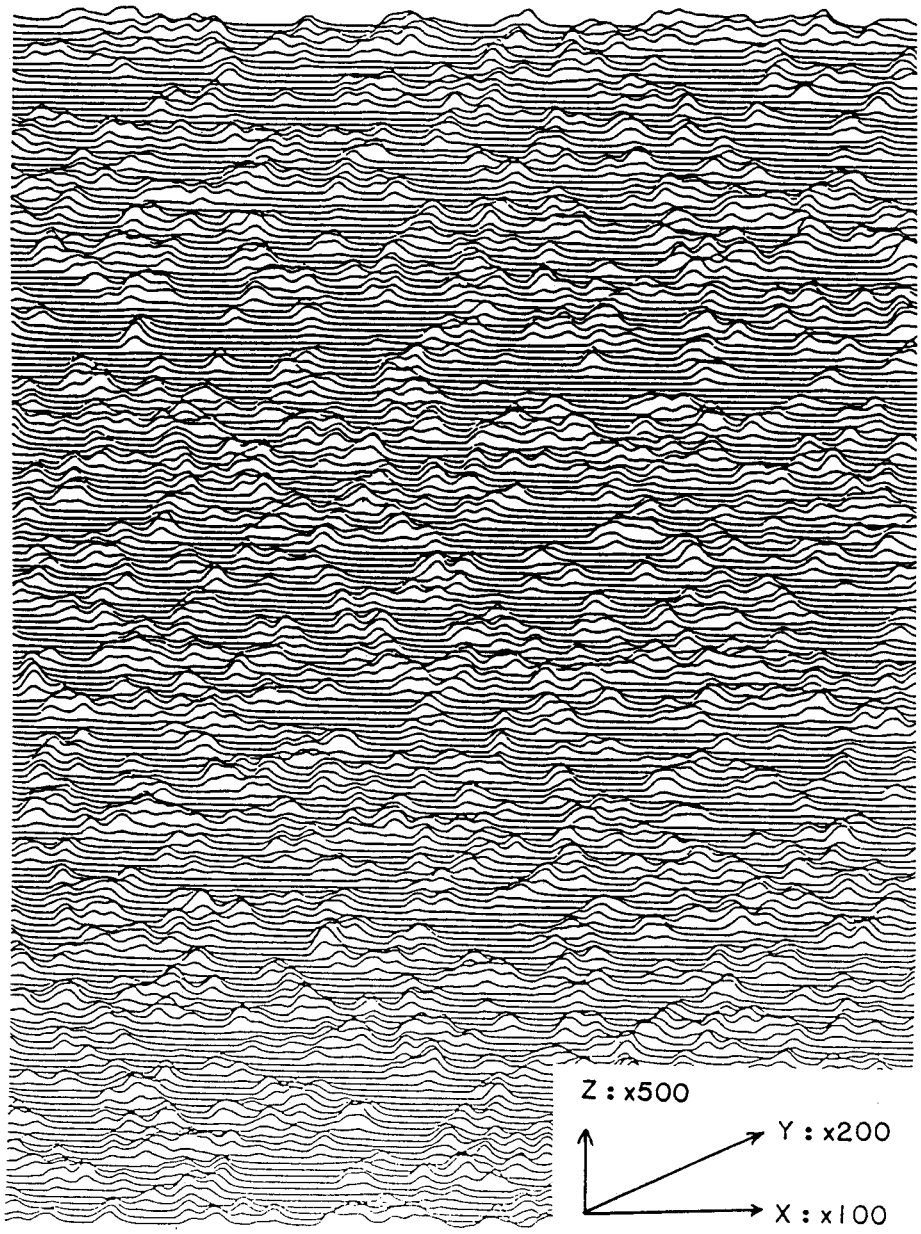
FIG. 4 is a chart representing a measured pattern of surface roughness of the abrasive tool shown in FIG. 3.
Figure 8:
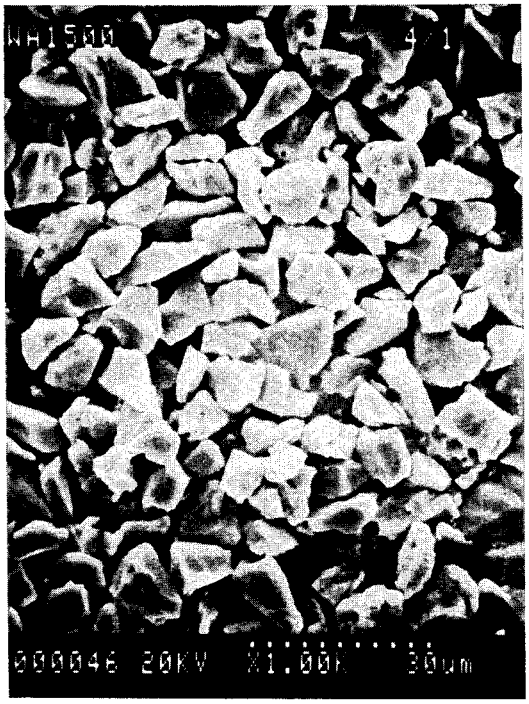

Microscopic inspection of the surfaces of all abrasive tools made in this example revealed no indication of particle overlap. FIG. 3 is a micrographic representation of the abrasive tool surface that used WA1500, among others. FIG. 4 is a stylus profile drawn by actually tracing the WA1500-incorporating surface. Further, Table 4 shows that abrasive coated surfaces that could be regarded as single layers were obtained.

EXAMPLE 2

In Example 1, the binder resin was replaced by a thermosetting resin ("VAGH" of Union Carbide Corp.), a vinyl chloride-vinyl acetate copolymer having a vinyl alcohol ingredient, and a hardening agent ("Coronate EH" of Nippon Polyurethane Industry Co.) therefor, and the ratio by weight of the abrasive particles (P) to the binder resin (R), or P/R, was varied as in Table 5. Coating solutions thus prepared were thermally cured to make abrasive tapes having a single-layer abrasive coat.

TABLE 5

| | Thermosetting type single-layer coating compositions (in ratios by weight) | |
|---|---|---|
| | WA 2000 | |
| | P/R = 0.25/1 | 0.5/1 |
| WA 2000 | 100 | 100 |
| Binder resin ("VAGH") | 308 | 153 |
| Hardening agent ("EH") | 92 | 47 |
| Solvent (cyclohexanone) | 120 | 100 |
| Total | 620 | 400 |
| | WA 8000 | |
| | P/R = 0.1/1 | 0.25/1 |
| WA 8000 | 100 | 100 |
| Binder resin ("VAGH") | 769 | 308 |
| Hardening agent ("EH") | 231 | 92 |
| Solvent (cyclohexanone) | 500 | 300 |
| Total | 1600 | 800 |

The surface roughness values of the coated surfaces were measured with a stylus type surface roughness meter. Table 7 gives the data, which suggest the possibility of forming coats that can be regarded as single layers despite variations in the mixing ratio of the key components. In fact, no overlap of particles was found within the field of vision when the coated surfaces were observed under a microscope. The variations of mixing ratio are not so critical, and apparently the average particle diameter, particle size distribution, and number of particles coated per unit area are important factors. Generally, too much binder resin makes it difficult to form a single layer because abrasive particles tend to be embedded in the resin. Conversely if the binder is insufficient the bond strength of the abrasive relative to the base decreases.

These abrasive tools, when used in grinding runs, gave results as summarized in Table 6. The tool using WA8000 was not appreciably different in performance from conventional abrasive tools. This is presumably ascribable to the too small average particle diameter of the abrasive powder. As will be clear from the table, the abrasive tools of the invention exhibit very high grinding characteristics.

TABLE 6

| | Surfaces ground with thermosetting type single-layer coats | | | | |
|---|---|---|---|---|---|
| | | Surface roughness (Å) | | Microscopic observation | |
| No. | P/R | Ra | Rmax | No. of irregularity | Scratch |
| WA 2000 | 0.25 | 200 | 1400 | 0 | No |
| | 0.5 | 180 | 1200 | 0 | No |

TABLE 7

| Ra, Rz, and Rmax values of alumina-thermoplastic type single-layer coats | | | | |
|---|---|---|---|---|
| No. | P/R | Ra (μm) | Rz (μm) | Rmax (μm) |
| 2000 | 0.25/1 | 0.7 | 5.6 | 9.6 |
| | 0.5/1 | 0.9 | 7.2 | 8.2 |
| 8000 | 0.1/1 | 0.2 | 1.2 | 2.6 |
| | 0.25/1 | 0.2 | 1.2 | 2.2 |

As will be obvious from the foregoing, the present invention as embodied above offers the following advantages:

(1) Because abrasive particles in a single layer wherein they are dispersed as uniformly in a binder resin as possible are bonded to a base such as of polyethylene terephthalate, the resulting abrasive film has a surface roughness corresponding to the particle size distribution and shape of the particles. Hence grinding is easily controlled to obtain desired work surface configurations.

(2) Interstices among the particles serve as chip pockets, thus preventing loading of the tool and extending its abrasive life (durability).

(3) Reduced tool friction with the workpiece during grinding (due to a decrease in area of contact between the abrasive film and the workpiece) improves the finish and precludes fusion of the binder resin with the heat of friction.

(4) The presence of particles in a single layer wherein they are spread as independently of one another as possible is a costsaving factor particularly where expensive abrasive powder such as diamond dust, CBN powder, or monocrystalline alumina powder is used.

TABLE 8

| | Surface roughness (Å) | | Microscopic observation | |
|---|---|---|---|---|
| Mesh No. | Ra | Rmax | No. of irregularity | Scratch |
| WA 800 | 500 | 4000 | 0 | No |
| WA 1000 | 250 | 1800 | 0 | No |
| WA 1500 | 220 | 1600 | 0 | No |
| WA 3000 | 200 | 1500 | 0 | No |
| WA 4000 | 150 | 1000 | 0 | No |
| WA 6000 | 80 | 400 | 0 | No |
| WA 8000 | 50 | 300 | 0 | No |
| WA 1200 | 300 | 2000 | 0 | No |
| WA 1500 | 240 | 1700 | 0 | No |
| WA 2000 | 230 | 1600 | 0 | No |

As will be obvious from Table 8, the abrasive tools having the abrasive coat of single-layer structure in conformity with the invention produced no surface flaw other than the normal grinding streak.

Figure 9:
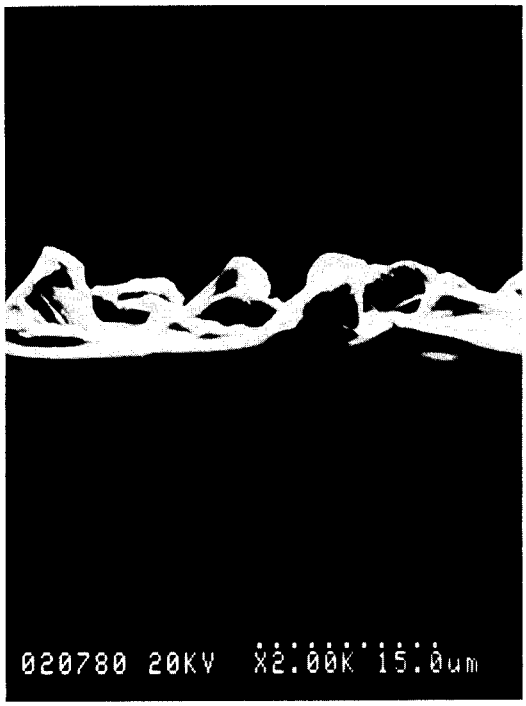

Microscopic inspection of the surfaces of all abrasive tools made in this example and test sections revealed no indication of particle overlap. FIG. 11 is a micrographic representation of the abrasive tool surface that used WA1500, among others. FIG. 9 shows a surface section of the abrasive using WA1500, which was confirmed to be a single particle layer substantially free of particle overlap.

COMPARATIVE EXAMPLE

As a binder resin, a thermosetting resin ("VAGH" of Union Carbide Corp.) which is a vinyl chloride-vinyl acetate copolymer having a vinyl alcohol ingredient was used together with a hardening agent ("Coronate EH" of Nippon Polyurethane Industry Co.) therefor. The ratio by weight of the abrasive particles (P) to the binder resin (R), or P/R, was varied as in Table 9. Coating solutions thus prepared were thermally cured to make abrasive tapes having a single-layer abrasive coat.

TABLE 9

| Thermosetting type single-layer coating compositions (in ratios by weight) WA 2000 | | |
|---|---|---|
| | P/R = 0.25/1 | 0.5/1 |
| WA 2000 | 100 | 100 |
| Binder resin ("VAGH") | 308 | 153 |
| Hardening agent ("EH") | 92 | 47 |
| Solvent (cyclohexanone) | 120 | 100 |
| Total | 620 | 400 |

These abrasive tools were used in texturing hard disks. It was confirmed upon inspection of the ground surfaces that there were some polymer deposits that appeared to be the binder resin component. With the slight resin deposit on the ground surfaces, coated hard disks as final products were tested for their magnetic characteristics. Dropouts and other defects were found.

In contrast to these, the abrasive tools having abrasive particles spread over a binder resin in a single layer and in tightly packed condition without any resin skin on the exposed particle surface yielded uniformly ground surfaces free of any contamination with resin deposit or the like. It was found that the latter greatly simplified the cleaning of ground surfaces.

As has been stated, these embodiments of the invention offer advantages as follows:

(1) Because abrasive particles forms but a single layer in which they are relatively tightly packed closely to one another without any resin layer on their working surfaces that act as a continuous mass of cutting edge, the resulting abrasive film has a surface roughness corresponding to the particle size distribution and shape of the particles. Hence grinding is easily controlled to obtain desired work surface configurations.

(2) The construction according to the invention obviates loading of the tool and extends its abrasive life (durability), whereas in conventional abrasive tools of multilayer structure the binder resin is partly responsible for loading.

(3) Fusion and deposition of the binder resin with the heat of friction between the tool and the workpiece during grinding is precluded.

(4) The presence of particles in a single layer is a cost-saving factor because it reduces the percentage of such high-grade abrasive powder as diamond dust, CBN powder, or monocrystalline alumina powder used.

What is claimed is:

1. A flexible abrasive tool comprising a flexible base film and an abrasive layer thereon composed of an abrasive powder having an average particle size of 1–20 μm embedded in a binder resin, said abrasive layer being in the form of a single particle layer in which the particles do not overlap one upon another.

2. An abrasive tool according to claim 1 wherein the abrasive particles are coated with the binder resin.

3. An abrasive tool according to claim 1 wherein the binder resin forms a layer of a thickness less than the average particle diameter of the particles in the abrasive powder layer.

4. An abrasive tool according to claim 1 wherein the abrasive particles include one or less overlapping particle per 100 particles.

5. An abrasive tool according to claim 1 wherein the binder resin is thermoplastic, thermosetting, or radiation curable.

6. An abrasive tool according to claim 1 wherein the base takes a form chosen from among tapes, and sheets.

7. A flexible abrasive tool comprising a flexible base film and an abrasive layer thereon composed of an abrasive powder having an average particle size of 1–5 μm embedded in a binder resin, said abrasive layer being in the form of a single particle layer in which the particles do not overlap one upon another.

8. An abrasive tool according to claim 1 wherein the binder resin does not coat the abrasive particles.

9. An abrasive tool according to claim 7 wherein the binder resin is thermoplastic, thermosetting, or radiation curable.

10. An abrasive tool according to claim 7 wherein the base takes a form chosen from among disks, tapes, and sheets.

11. A method of manufacturing a flexible abrasive tool which comprises embedding an abrasive powder having an average particle size of 1–20 μm in a dilute solution of a binder resin and a solvent and then thinly applying the resulting coating material to a flexible base in such a manner that the particles form a single particle layer in which the particles do not overlap or rest one upon another.

* * * * *